US011473361B1

(12) United States Patent
Sisco et al.

(10) Patent No.: US 11,473,361 B1
(45) Date of Patent: Oct. 18, 2022

(54) SAFE

(71) Applicant: Urban Safes, LLC, Edgartown, MA (US)

(72) Inventors: Eugene F. Sisco, Edgartown, MA (US); Eric Chan, New York, NY (US)

(73) Assignee: Urban Sales, LLC, Edgartown, MA (US)

( * ) Notice: Subject to any disclaimer, the term of this patent is extended or adjusted under 35 U.S.C. 154(b) by 348 days.

(21) Appl. No.: 16/792,440

(22) Filed: Feb. 17, 2020

Related U.S. Application Data

(63) Continuation of application No. 29/695,761, filed on Jun. 21, 2019, now Pat. No. Des. 876,044.

(51) Int. Cl.

| | |
|---|---|
| ***E05G 1/026*** | (2006.01) |
| ***E05B 47/06*** | (2006.01) |
| ***E05G 1/04*** | (2006.01) |
| ***E05G 1/06*** | (2006.01) |
| ***E05B 47/00*** | (2006.01) |

(52) U.S. Cl.
CPC ..... *E05G 1/026* (2013.01); *E05B 47/06* (2013.01); *E05G 1/04* (2013.01); *E05G 1/06* (2013.01); *E05B 2047/0084* (2013.01)

(58) Field of Classification Search
CPC ..... Y10T 70/5031; Y10S 292/72; E05G 1/08; E05G 1/026; E05G 1/04; E05G 1/06; E05B 47/06; E05B 2047/0084; A47B 46/00; A47B 46/005
USPC ..... 109/45, 48, 53, 54, 66–68, 59 R, 59 T; 312/222, 311, 321.5, 409; 248/551–553
See application file for complete search history.

(56) References Cited

U.S. PATENT DOCUMENTS

| | | | | |
|---|---|---|---|---|
| 166,107 | A | | 7/1875 | Hyatt |
| 368,887 | A | * | 8/1887 | Dake |
| 392,682 | A | | 11/1888 | McNamara |
| 526,181 | A | * | 9/1894 | Fowler |
| 963,883 | A | * | 7/1910 | Farley |
| 1,048,774 | A | | 12/1912 | Whittam |

(Continued)

FOREIGN PATENT DOCUMENTS

| | | | |
|---|---|---|---|
| CN | 301095005 | S | 12/2009 |
| CN | 301989567 | S | 7/2012 |

(Continued)

OTHER PUBLICATIONS

Anonymous, Stack-on anti-theft lock box drop down door qas-1304, Dean Safe, https://www.deansafe.com/stackonqas1304.html Accessed Date: Jan. 29, 2018.

*Primary Examiner* — Lloyd A Gall
(74) *Attorney, Agent, or Firm* — Werschulz Patent Law, LLC; Patricia P. Werschulz, Esq.

(57) ABSTRACT

A safe for mounting on a shelf with a drop-down door that provides a work surface to sort a safe's contents. The drop-down door is congruent with a floor panel of the safe, forming a continuous working area. Within the drop-down door, there is a concealed document pocket. The drop-down door is substantially flush with a pair of side walls and a ceiling wall when closed. A spring plunger pushes the door open when the lock is disengaged. The safe has a back-lit shelf within an interior chamber. The safe is secured to the shelf by a bottom lock assembly with rotatable mounting plate concealed by the floor panel of the safe. In one example embodiment, the door is secured by a locking mechanism with a plurality of rotating pins.

19 Claims, 12 Drawing Sheets

(56) References Cited

U.S. PATENT DOCUMENTS 3,025,692 A * 3/1962 Tomkinson ..... E05B 65/50 70/67
3,791,709 A 2/1974 Cross
4,106,597 A * 8/1978 Shook ..... A45C 13/02 190/110
4,370,935 A * 2/1983 Link ..... E05D 7/14 109/51
4,647,118 A 3/1987 Kamperman
D291,019 S 7/1987 Druihet
4,926,762 A * 5/1990 Paul ..... B60R 7/087 109/51
D308,744 S 6/1990 Arauchi
5,067,755 A * 11/1991 James ..... E05B 65/0075 109/59 R
5,085,491 A 2/1992 Lautenschlager
5,088,776 A * 2/1992 James ..... E05B 65/0075 109/59 R
5,163,745 A * 11/1992 Zagata ..... A47B 96/00 312/223.5
5,738,020 A * 4/1998 Correia ..... E05G 1/005 109/51
5,778,805 A * 7/1998 Green ..... E05B 47/023 109/51
5,870,910 A * 2/1999 Specht ..... E05G 1/005 248/225.11
5,873,481 A * 2/1999 Gruhn ..... E05C 7/02 206/390
6,085,671 A * 7/2000 Kerr ..... E05G 1/005 109/51
D446,378 S 8/2001 Fischer
6,283,608 B1 * 9/2001 Straat ..... F21S 8/00 362/127
6,371,288 B1 4/2002 Licata
D461,617 S 8/2002 Gardner
6,811,006 B1 * 11/2004 Mundle ..... A45C 13/02 190/18 R
6,820,953 B2 * 11/2004 Wojcik ..... G11B 33/025
6,843,081 B1 * 1/2005 Painter ..... F41C 33/06 42/70.11
D571,524 S 6/2008 Kang et al.
D617,974 S 6/2010 Alfeld
8,167,131 B1 * 5/2012 Anderson ..... A45F 3/02 190/102
8,800,799 B1 * 8/2014 Hawker ..... B65D 43/163 109/51
8,910,498 B2 * 12/2014 Saucier ..... A47G 29/10 70/164
9,016,095 B2 * 4/2015 Dudgeon ..... E05G 1/08 70/164
D732,264 S 6/2015 Hine et al.
D732,265 S 6/2015 Osiecki et al.
D748,365 S 1/2016 Nelson
D799,149 S 10/2017 Chafetz
D802,872 S 11/2017 Frisher
9,844,264 B1 12/2017 Stewart
D811,687 S 2/2018 Kang
D814,139 S 3/2018 Newcomb
9,911,254 B2 3/2018 Ng et al.
D814,739 S 4/2018 Coutinho et al.
D849,354 S 5/2019 Chen
D853,078 S 7/2019 Rayfield et al.
D876,044 S * 2/2020 Sisco ..... D99/28
2005/0188733 A1 9/2005 Blankenau
2011/0050058 A1 * 3/2011 Smith ..... A47B 67/005 312/227
2011/0100074 A1 * 5/2011 Meekma ..... E05B 19/0005 70/63
2014/0076208 A1 * 3/2014 Schulz ..... E05G 1/005 109/52
2015/0343958 A1 * 12/2015 McGoldrick ..... E05G 1/04 29/428

FOREIGN PATENT DOCUMENTS

CN 202567032 U 12/2012
CN 302450433 S 6/2013
CN 302450434 S 6/2013
CN 303785854 S 8/2016
CN 206190110 U 5/2017
CN 304308281 S 10/2017
CN 304765646 S 8/2018
EP 0868868 B1 5/2003
JP 1500819 S 5/2014
JP 1589324 S 10/2017
KR 3006961370000 5/2013
KR 3006961380000 5/2013
KR 3007998120000 6/2015
KR 3008165230000 9/2015
KR 3008545890000 5/2016

* cited by examiner

SAFE

CROSS-REFERENCE TO RELATED APPLICATIONS

This application is a nonprovisional utility application that claims priority to the design patent application, Ser. No. 29/695,761, filed in the United States Patent Office on Jun. 21, 2019, and claims the priority thereof and is expressly incorporated herein by reference in its entirety.

TECHNICAL FIELD

The present disclosure relates generally to a safe. More particularly, the present disclosure relates to a personal safe such as one found in a hotel room.

BACKGROUND

Travelers staying in hotels and other similar public accommodations generally wish to secure personal valuables, especially when they leave their valuables unattended.

Typically, a hotel supplies a small safe sitting on a shelf inside a closet that allows the guest to select a combination to lock and unlock the safe or alternatively, the hotel supplies a key.

Generally, these safes have relatively small cavities and access is sometimes awkward, depending on how the safes are installed in the closet.

While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a safe that sits on a shelf or like structure that does not open from a side. Accordingly, an aspect of an example embodiment in the present disclosure provides a safe that has a drop-down door that opens from a top.

Another aspect of an example embodiment in the present disclosure is to provide a safe with a working area for sorting small items. Accordingly, the present disclosure provides a drop-down door with an inner side covered by a work surface for sorting small items.

A further aspect of an example embodiment in the present disclosure is to provide a concealed storage space for documents. Accordingly, the present disclosure provides a concealed document pocket for storing documents under the work surface of the drop-down door.

Another aspect of an example embodiment in the present disclosure is to provide light inside an interior chamber. Accordingly, the present disclosure provides a back-lit clear shelf, illuminated by an LED strip to provide light inside an interior chamber.

Accordingly, the present disclosure describes a safe for mounting on a shelf with a drop-down door that provides a work surface to sort a safe's contents. The drop-down door is congruent with a floor panel of the safe, forming a continuous working area. Within the drop-down door, there is a concealed document pocket. The drop-down door is substantially flush with a pair of side walls and a ceiling wall when closed. A spring plunger pushes the door open when the lock is disengaged. The safe has a back-lit shelf within an interior chamber. The safe is secured to the shelf by a bottom lock assembly with rotatable mounting plate concealed by the floor panel of the safe. In one example embodiment, the door is secured by a locking mechanism with a plurality of rotating pins.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
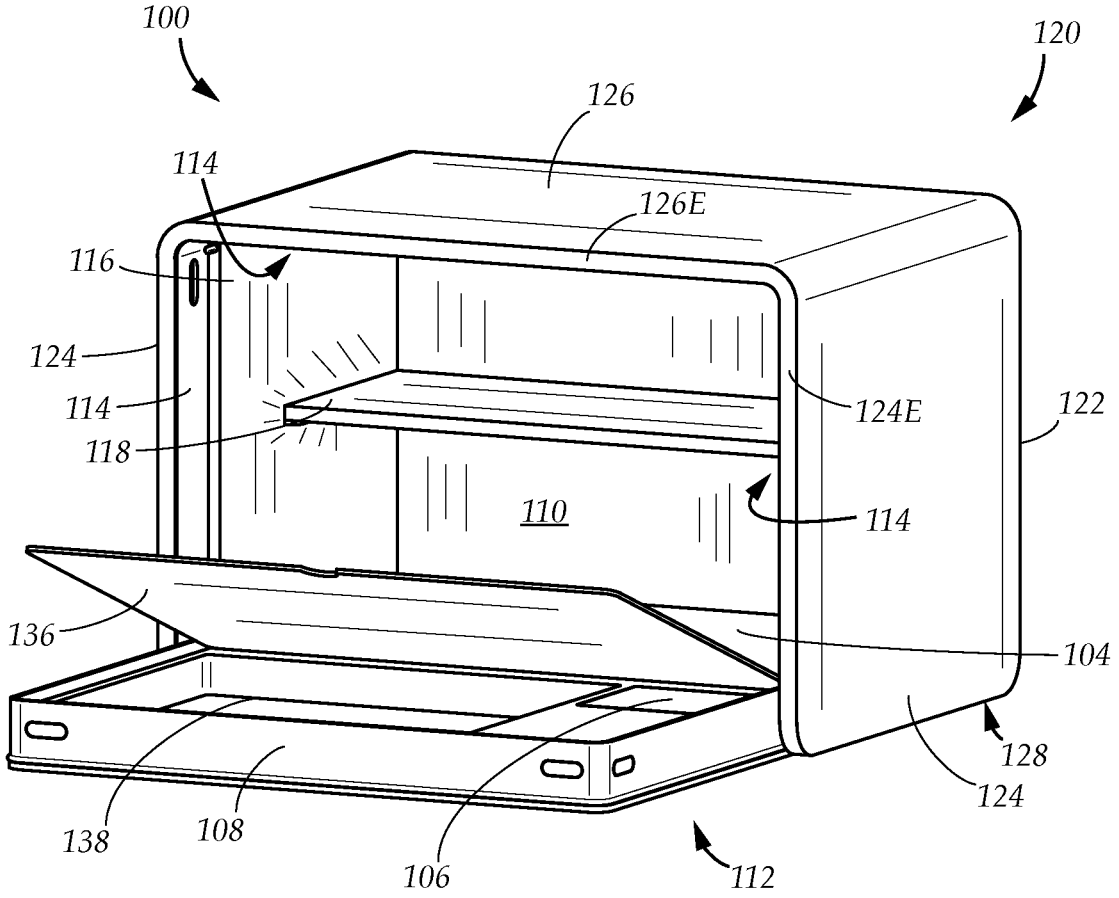
FIG. 1 is a perspective view of an example embodiment of a safe with a door in an open position, showing a document pocket.
Figure 2:
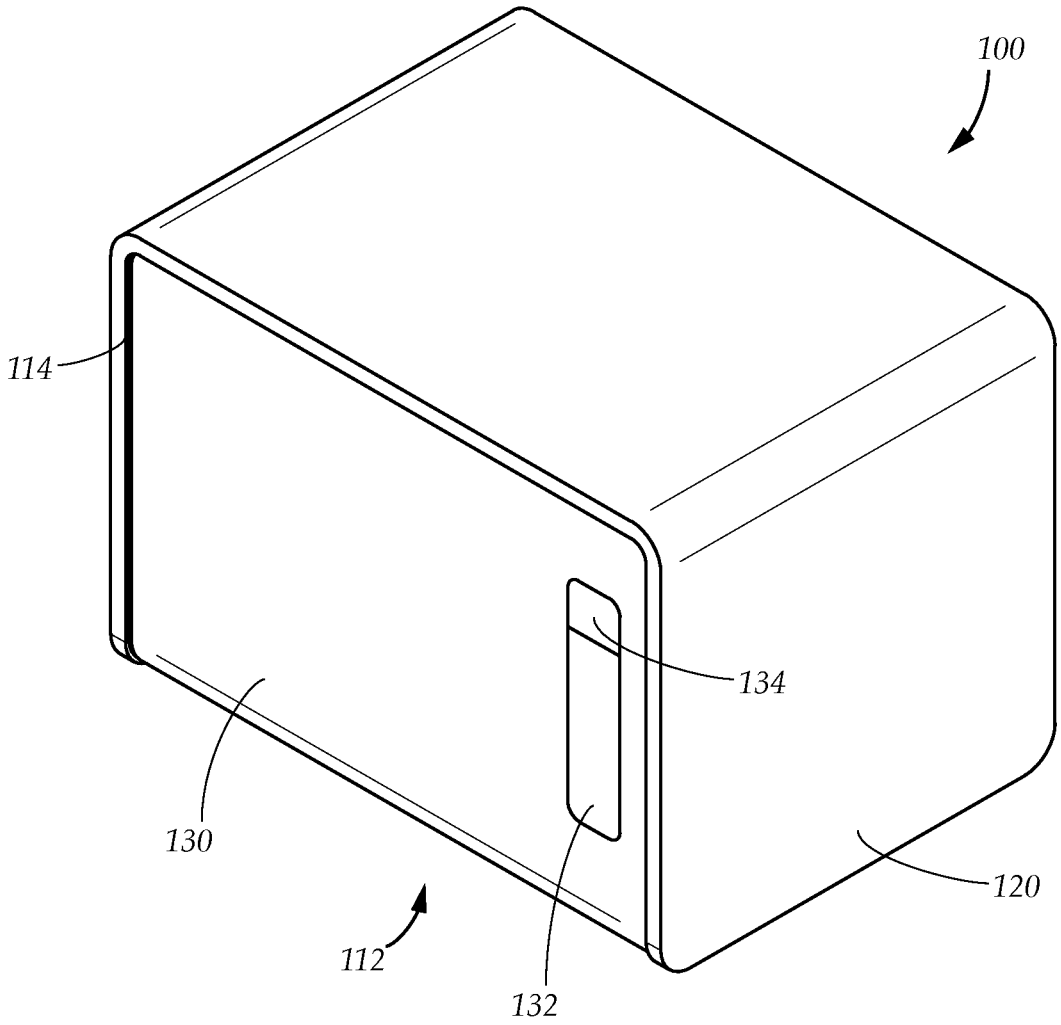
FIG. 2 is a perspective view of the example embodiment of the safe with the door in a closed position.
Figure 3:
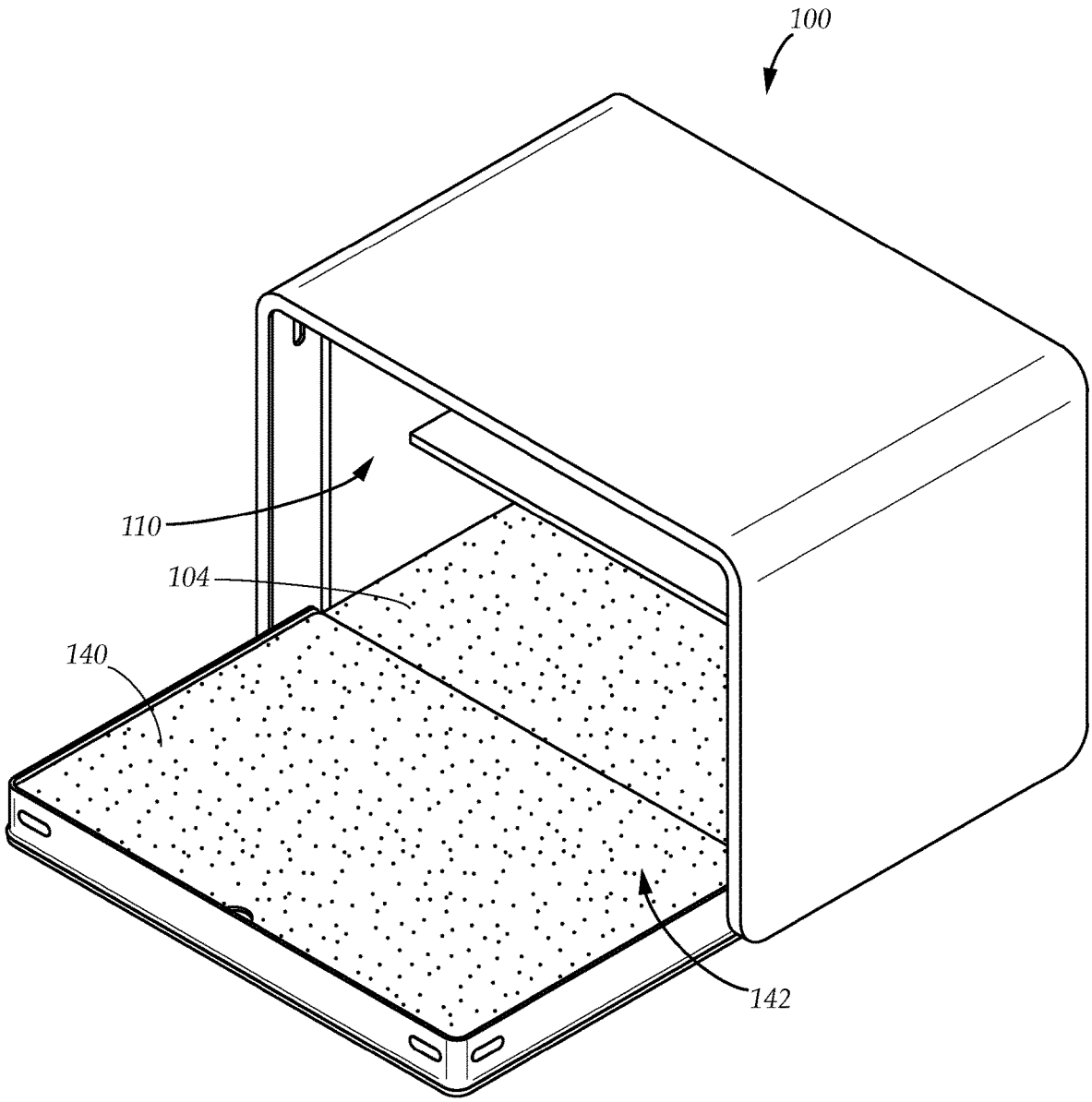
FIG. 3 is a perspective view of the example embodiment of the safe with the door in the open position.

FIGS. 1-3 illustrate an example embodiment of a safe 100 for securing valuables. Typically, such safes are often found in hotels and other places where a transient user has needs to temporarily secure valuables. Non-transient users may also use such safes in a home or an office because of the ease of concealing in a closet or cabinet. Such safes are generally affixed to a permanent structure such as a shelf or counter. While the safe 100 of the present disclosure is extremely well-suited for such uses, these are not limitations of the example embodiments described below.

FIG. 1 shows an example embodiment of the safe 100 with a drop-down door 112 in an open position. The safe 100 has a shell 120, having a rear wall 122, a pair of side walls 124, a ceiling 126, a floor 128. The pair of side walls, the ceiling and the floor each having an edge 124E and 126E, the edges in combination defining an open front. The pair of side walls 124, the rear wall 122, the ceiling 125 and the floor 128 substantially define an interior chamber 110 having a volume defined by the pair of side walls 124, the rear wall 122, the ceiling 125 and the floor 128 when the drop-down door is closed.

There is a flange 114 along the edges 124E and 126E.

Inside the shell, there is liner 116 covering the rear wall 122 and substantially covering the pair of side walls 124 and ceiling 126 without covering the flange 114.

Covering the floor 128 is a floor panel 104. The liner 116, the floor panel 104 and the drop-down door 112 further define the interior chamber 110 of the safe 100 when the drop-down door 112 is closed as shown in FIG. 2.

The drop-down door 112 has an inner side 136, an outside front panel 130 and a document pocket 138 therebetween, the inner side covered by a work surface 140, the work surface concealing the document pocket.

The safe 100 has a shelf 118 in the interior chamber 110. In one example embodiment, the shelf 118 is an illuminated shelf made from glass or other translucent material and is back-lit by an LED strip (which cannot be easily illustrated in these drawings). The edges of the glass shelf 118 are frosted to produce an edge lighting effect that enhances visibility within the interior chamber.

The drop-down door 112 has an outside front panel 130 with a lock panel 132 configured for locking and unlocking the drop-down door. In one example embodiment, the lock panel 132 is a programmable digital lock.

The lock panel 132 has a concealed keyhole described hereinbelow for a mechanical key behind an upper panel 134 on the lock panel 132. In one example embodiment, the upper panel 134 magnetically attaches to the lock panel 132.

The LED strip for the shelf 118 and the lock panel are powered by a battery 106 between the inner side 136 and the outside front panel 130 of the drop-down door 112.

Focusing on FIG. 3, when the drop-down door 112 is fully open, the work surface 140 of the drop-down door 112 and the floor panel 104 are congruent and in combination, form a planar working area 142. This is particularly advantageous when a user needs to sort through small items such as rings, earrings and coins, which can be scooped forward onto the work surface 140, sorted and then removed or returned into the interior chamber 110, lessening the chances of dropping or losing the valuable items.

Figure 4:
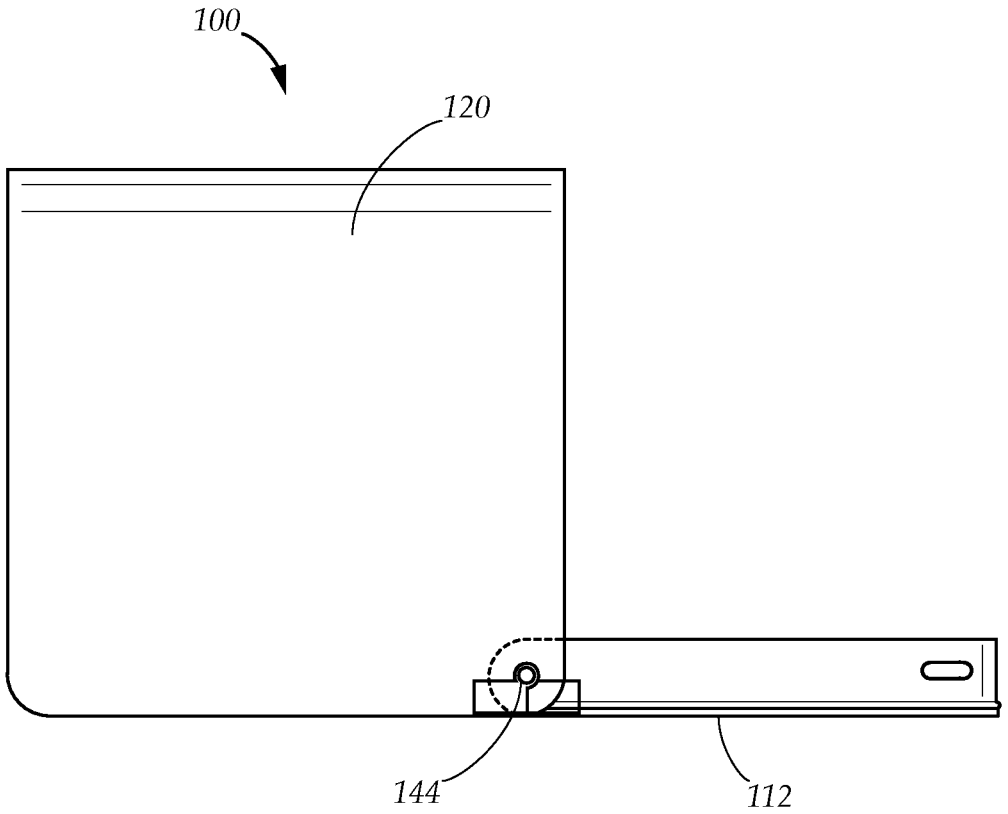
FIG. 4 is a side elevational view of the example embodiment of the safe with the door in the open position.
Figure 5:
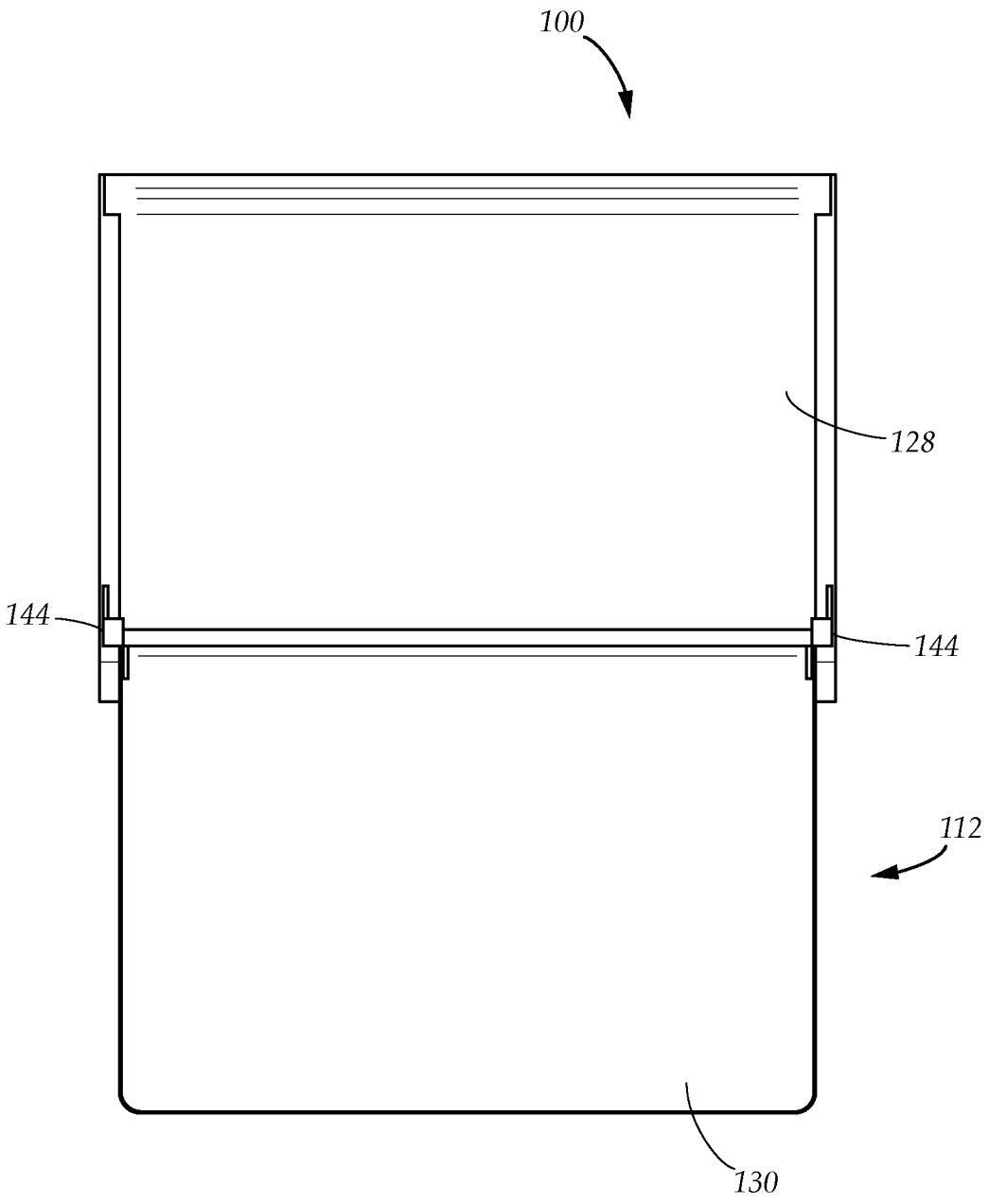
FIG. 5 is a bottom plan view of the example embodiment of the safe with the door in the open position.

Referring to FIGS. 4 and 5, the drop-down door 112 is hingedly attached to the shell by a concealed torque hinge 144, the concealed torque hinge dampening the drop-down door as it descends, especially the last fifteen degrees of descent, until the drop-down door 112 is in line with the floor 128.

When the drop-down door 112 is closed, as shown in FIG. 2, the drop-down door is within the shell 120 and does not protrude beyond the flange 114 of the shell. When the drop-down door 112 closes, it automatically locks. By the drop-down door-being substantially flush with the shell 120, it provides an extra level of security, making it difficult to pull the door off by force. There is nothing to grab or a place to gain purchase. There are no visible hinges to dissemble because the concealed torque hinge 144 is hidden.

Figure 6:
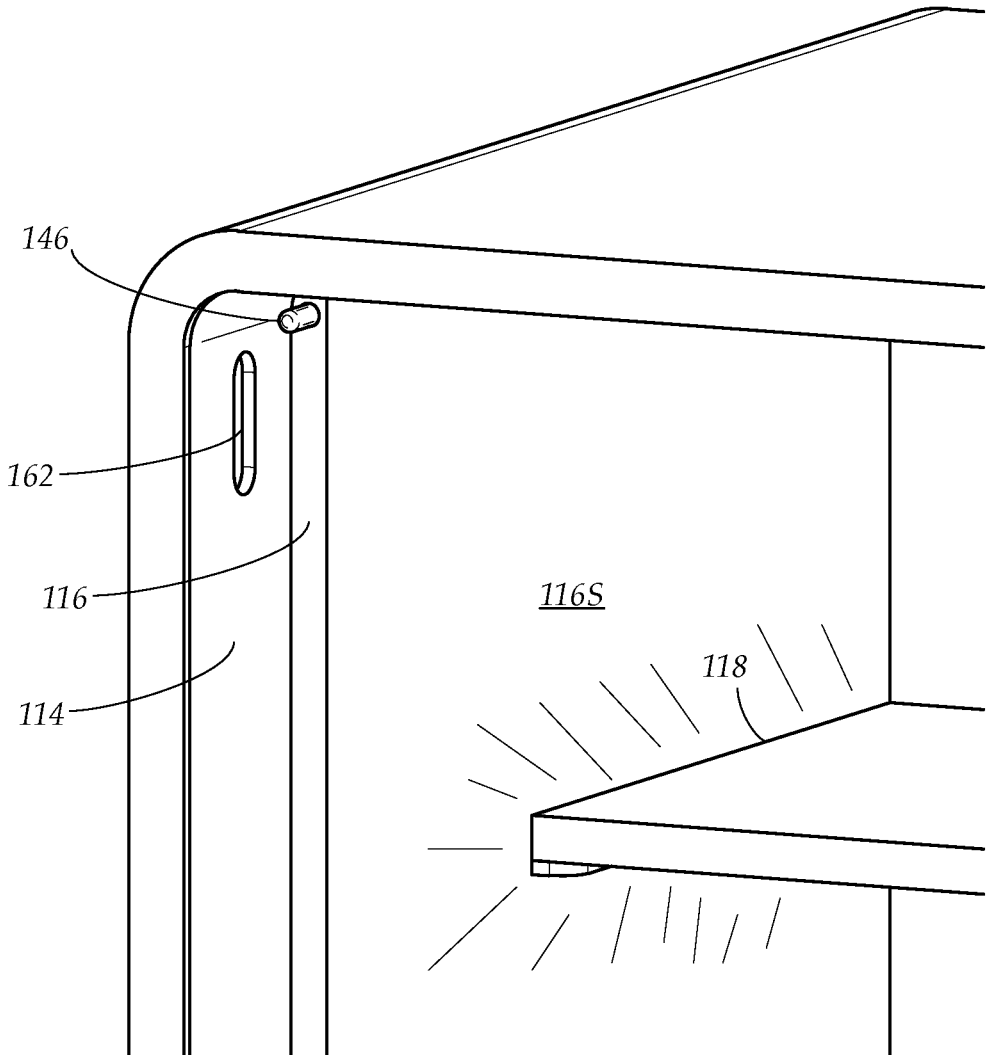
FIG. 6 is a partial perspective view of an example embodiment of a spring plunger and a strike plate of the locking mechanism assembly.
Figure 7:
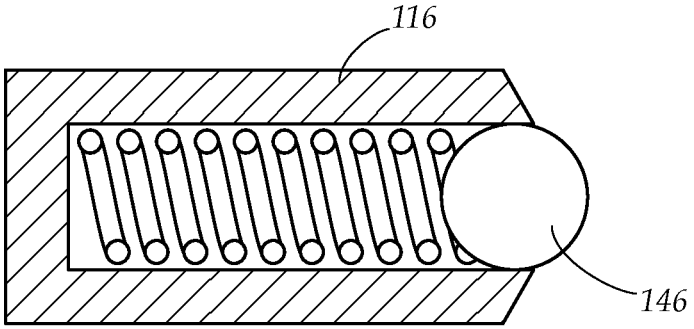
FIG. 7 is a side view of an example embodiment of the spring plunger.
Figure 8:
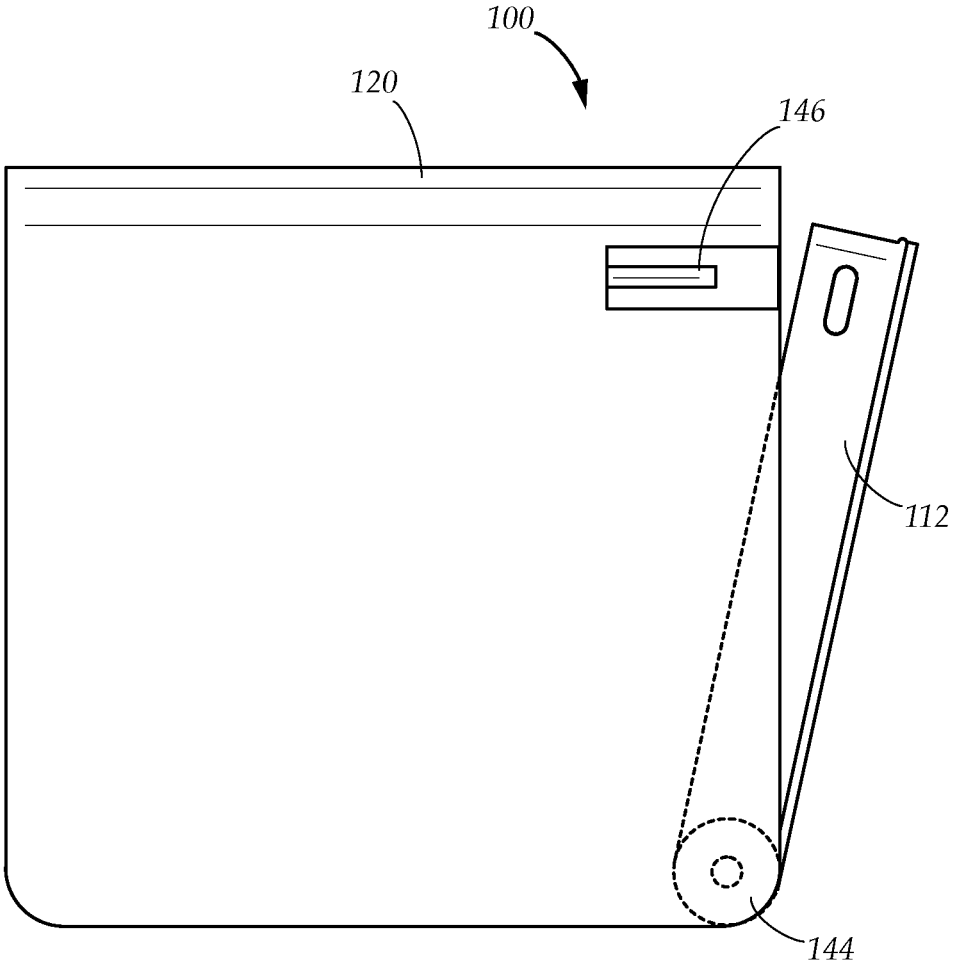
FIG. 8 is a side elevational view of the example embodiment of the safe with the door in a slightly open position.

As shown in FIGS. 6-8, to unlock the drop-down door 112, there is at least one spring plunger 146 embedded in the liner 116 of at least one side wall 124, orthogonal to a surface of the at least one side wall liner 116S, the at least one spring plunger 146 pushing the drop-down door downwardly about five degrees when the drop-down door is unlocked. Gravity moves the drop-down door 112, the concealed torque hinge dampening the drop-down door as it descends, especially the last fifteen degrees of descent.

Figure 9:
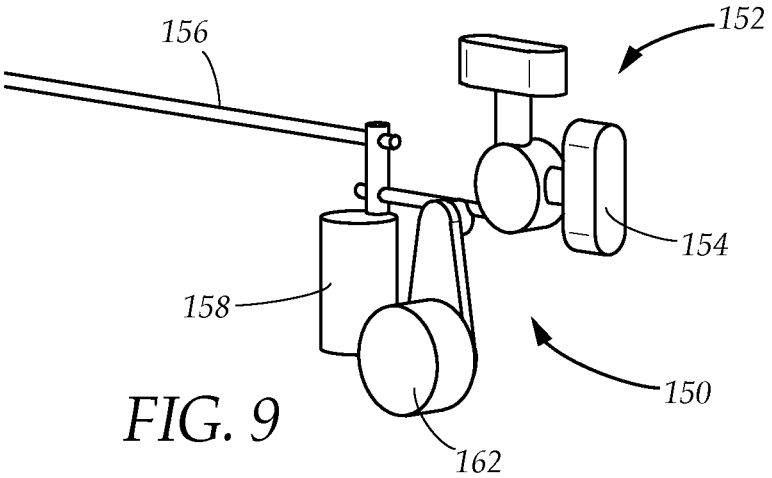
FIG. 9 is a partial perspective view of an example embodiment of a locking mechanism.
Figure 10:
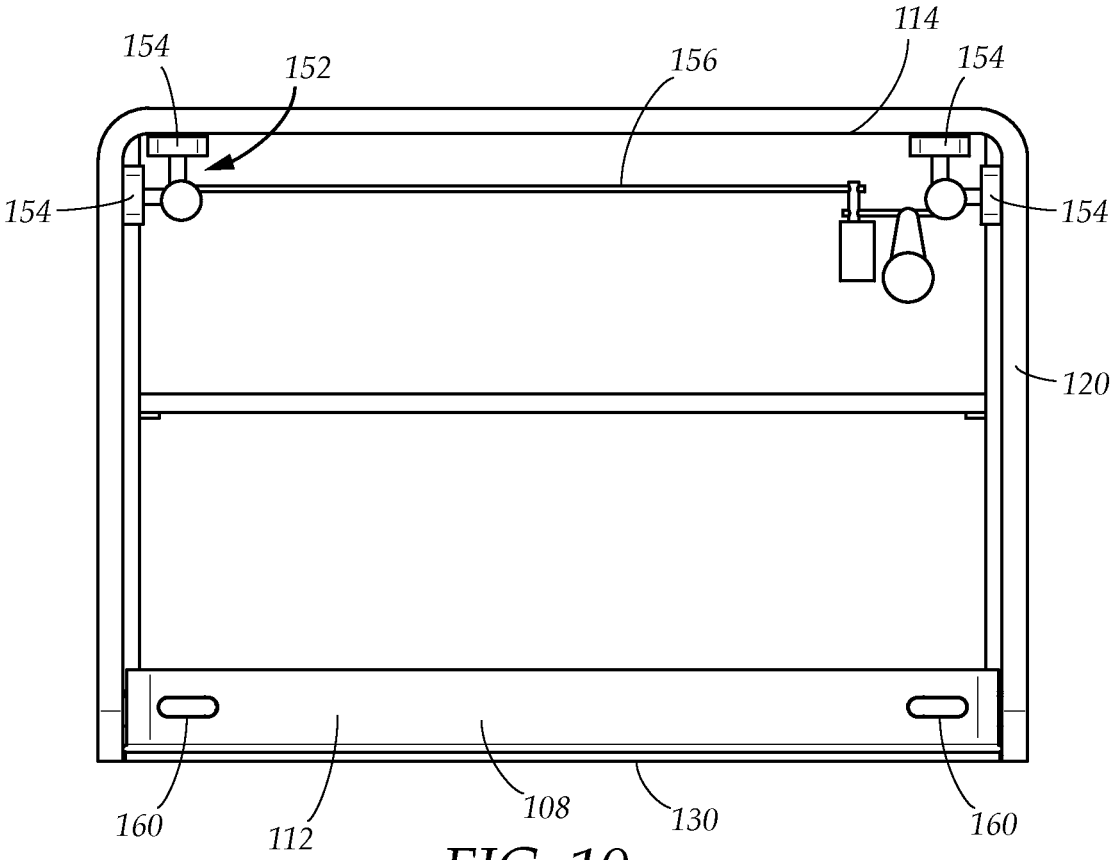
FIG. 10 is a front elevational view of the example embodiment of the locking mechanism without a front door panel.
Figure 11:
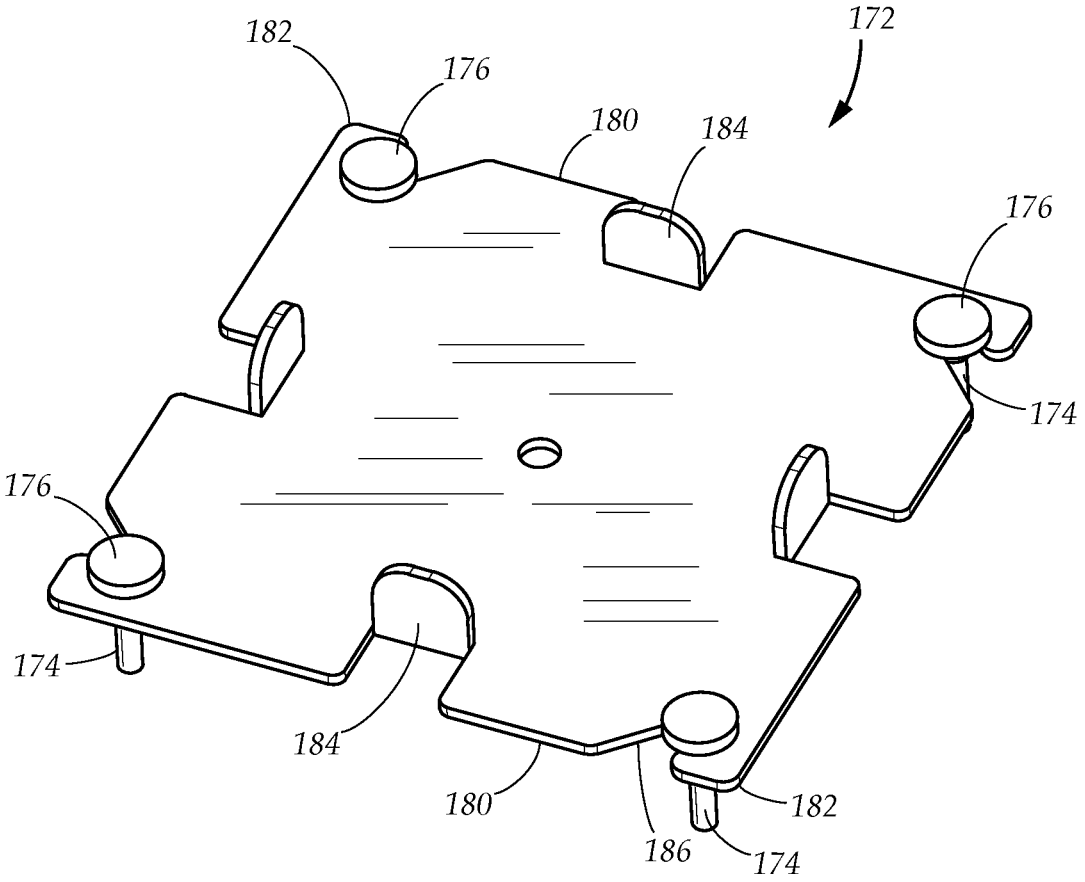
FIG. 11 is a perspective view of an example embodiment of a mounting plate.
Figure 12:
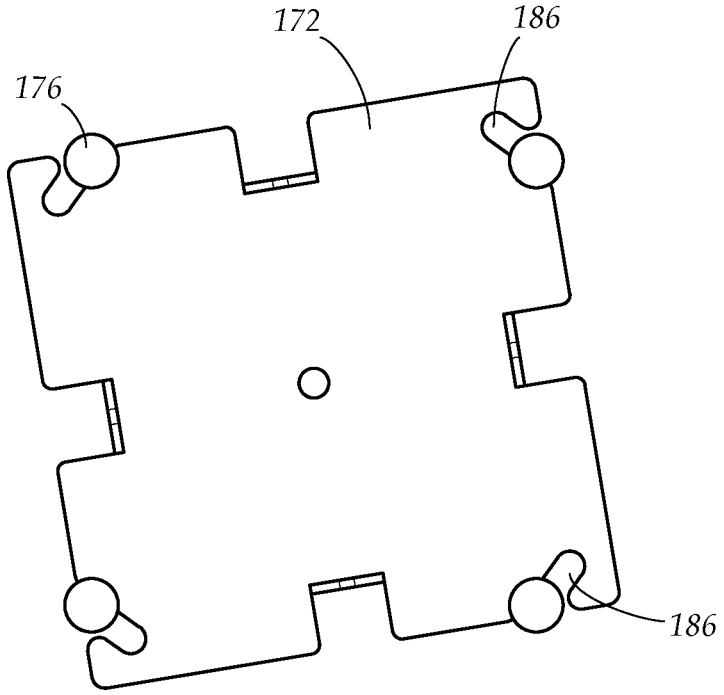
FIG. 12 is top plan view of the example embodiment of the mounting plate prior to installation.
Figure 13:
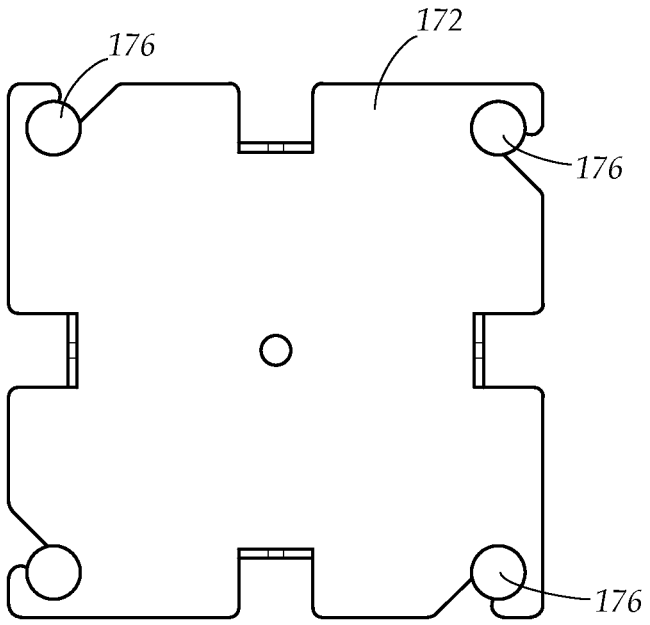
FIG. 13 is top plan view of the example embodiment of the mounting plate after installation.
Figure 14:
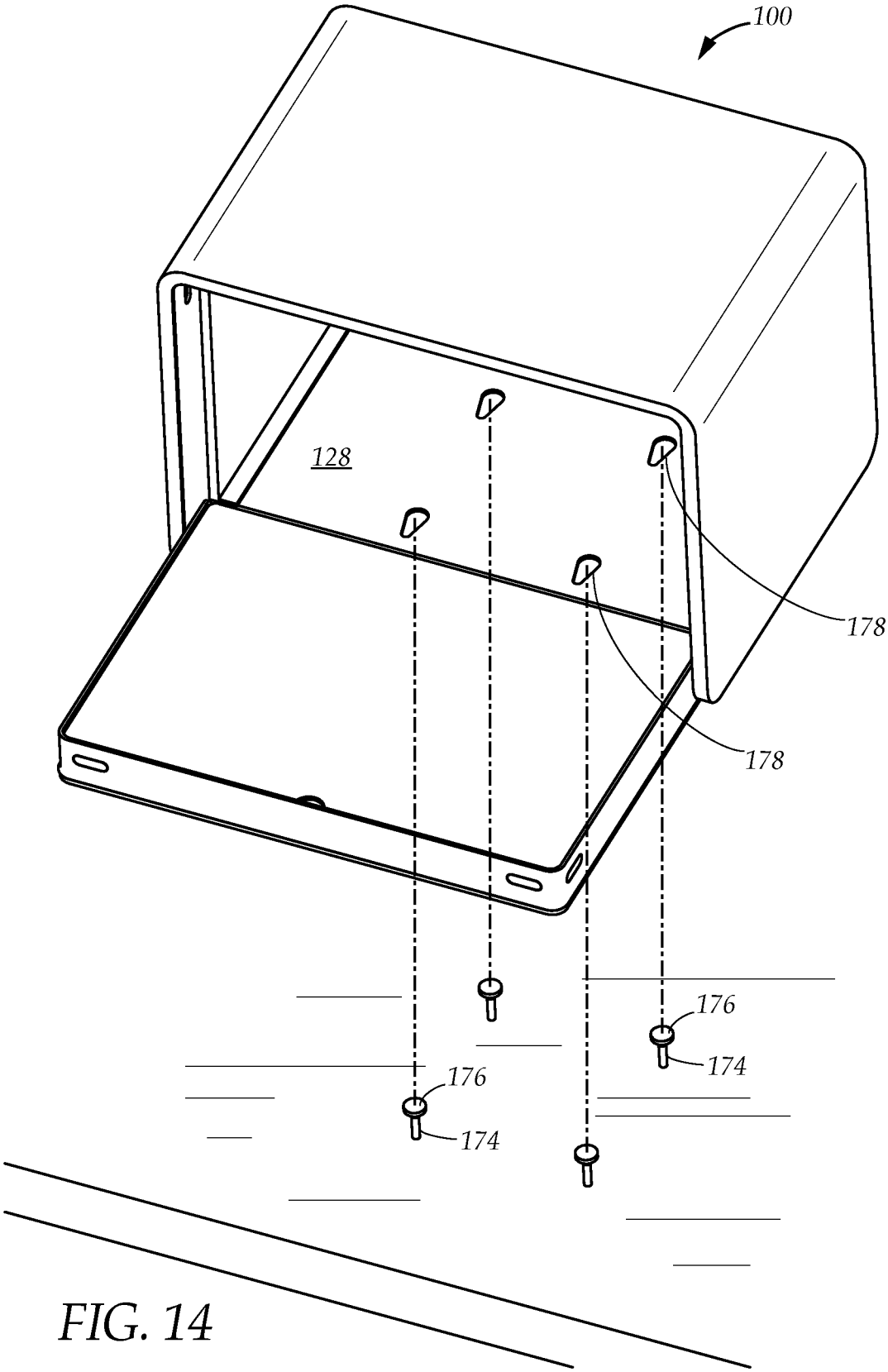
FIG. 14 is a perspective view of the example embodiment of the safe during installation.
Figure 15:
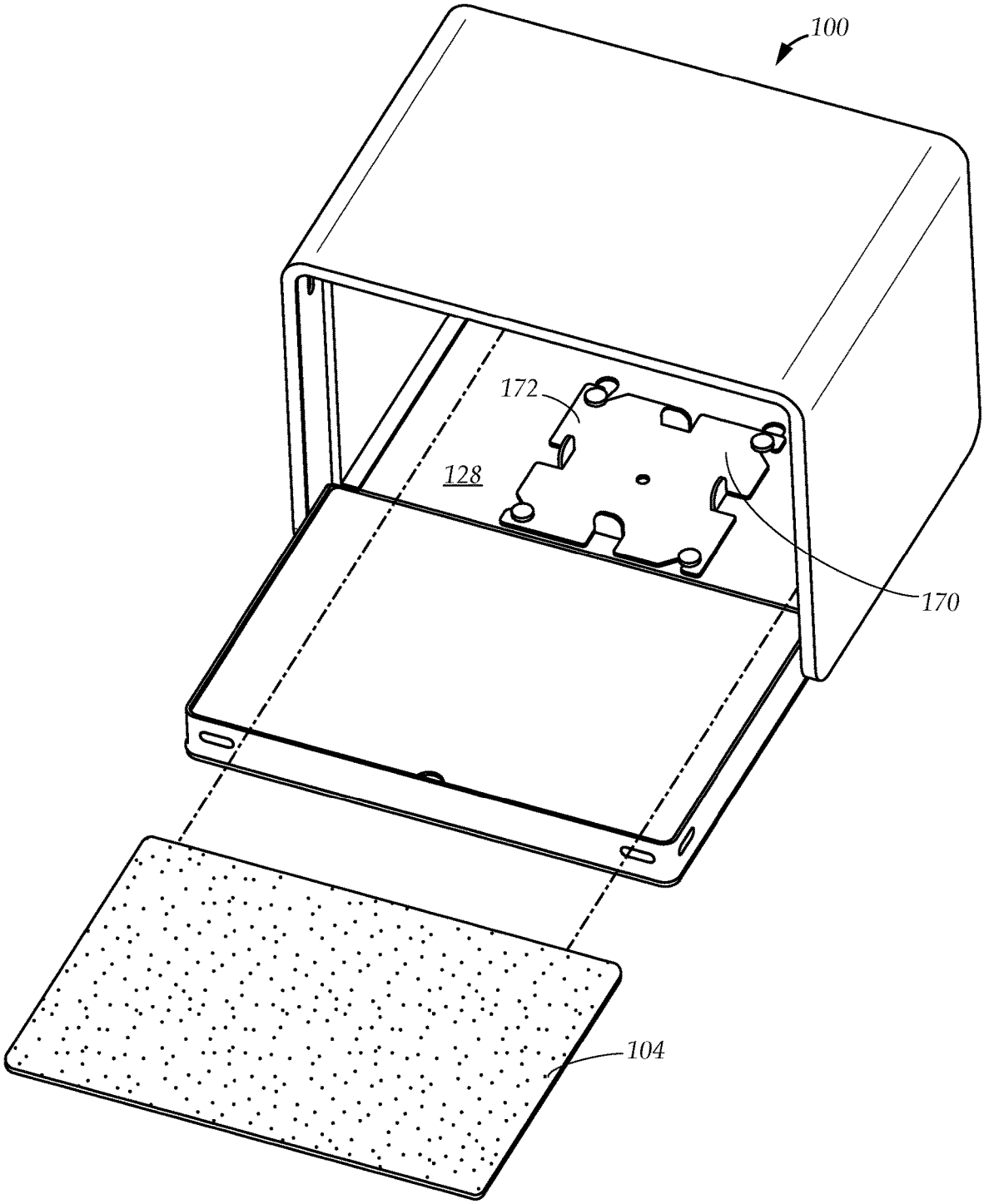
FIG. 15 is a perspective view of the example embodiment of the safe during the final step of the installation.

FIGS. 9-10 illustrate a locking mechanism assembly 150 within the drop-down door 112 having two pairs 152 of pins 154, a first pair of pins on a right side of the drop-down door and a second pair of pins on a left side of the drop-down door, a first pin 154 orthogonal to a second pin 154 within each pair 152, the two pairs connecting by a rod 156 driven by a rotational motor 158 that drives the pins outwardly through a plurality of pin slots 160 in the door flange 108 to lock and inwardly to unlock the drop-down door 112. The pins 154 engage a plurality of flange slots 162 in the flange 114, as shown in FIG. 6.

FIG. 10 shows the locking mechanism assembly 150 outside of the drop-down door 112 to show the relationship between the locking mechanism in the shell 120. It is understood that the locking mechanism 150 is between the outside front panel 130 and the inner side 136 of the drop-down door 112, concealed by the work surface which is not shown. The locking mechanism 150 is further concealed from the document pocket.

FIGS. 11-15 illustrate a horizontal lock assembly 170 for locking the safe 100 to an external structure. The horizontal lock assembly 170 is concealed below the floor panel 104.

The horizontal lock assembly 170 comprises a mounting plate 172, a plurality of bolts 174 each with a head 176 and a plurality of openings 178 in the floor 128 of the safe 100.

The mounting plate 172 is a square have four sides 180 and four corners 182 with a thumb tab 184 on each side and a curvilinear slot 186 on each corner, the four slots engaging the heads 176 of the bolts 174 when the bolts are placed through the openings 178 in the floor 128 of the safe 100 and into the external structure, locking the heads 176 of the bolts 174 into the curvilinear slots 186 when the mounting plate rotates.

To secure the safe 100 to a horizontal structure such as a shelf, an installer first affixes the four bolts 174 to the shelf. It is understood by those of ordinary skill in the art that the disclosure is using the term "shelf" for the sake of simplicity to represent a permanent horizontal structure and that "shelf" is not a limitation.

The installer allows the heads 176 to remain above the surface of the horizontal structure. The installer places the safe 100 with the floor panel 104 removed over the bolts 174 and lowers the safe so that the heads 176 of the bolts 174 extend through the openings 178 of the floor 128. The installer places the mounting plate 172 between the bolts 174. The installer rotates the mounting plate 172 using the thumb tabs 184 until the heads 176 of the bolts 174 are engaged in the curvilinear slots 186, locking the bolts in place. The installer replaces the floor panel 104, concealing the horizontal lock assembly 170.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a safe. The disclosure is illustrated by example in the drawing figures, and throughout the written description. It should be understood that numerous variations are possible, while adhering to the inventive concept. Such variations are contemplated as being a part of the present disclosure.

What is claimed is:

1. A safe, comprising:

an interior chamber, having a volume defined by a pair of side walls, a rear wall, a ceiling and a floor, the pair of side walls, the rear wall, the ceiling and the floor forming a shell;

a drop-down door further defining the volume of the interior chamber, wherein the drop-down door has an inner side, an outside front panel and a document pocket therebetween, the inner side covered by a work surface, the work surface concealing the document pocket, and the floor of the interior chamber has a floor panel such that when the drop-down door is fully open, the work surface of the inner side of the drop-down door and the floor panel are congruent, precluding a gap, and in combination, form a planar working area; and a shelf in the interior chamber.

2. The safe as described in claim 1, further comprising at least one spring plunger embedded in a liner of at least one side wall, orthogonal to a surface of the liner of at least one side wall liner, the at least one spring plunger pushing the drop-down door downwardly when the drop-down door is unlocked.

3. The safe as described in claim 2, wherein the drop-down door is attached to the shell by a concealed hinge that dampens the descent of the drop-down door.

4. The safe as described in claim 3, wherein the outside front panel of the drop-down door has a lock panel configured for locking and unlocking the drop-down door.

5. The safe as described in claim 4, wherein the lock panel has a programmable digital lock.

6. The safe as described in claim 5, wherein the lock panel has a hidden keyhole for a mechanical key to unlock the drop-down door.

7. The safe as described in claim 6, further comprising a battery between the inner side and the outside front panel of the drop-down door.

8. The safe as described in claim 7, wherein the shelf in the interior chamber is illuminated by an LED strip powered by the battery between the inner side of the drop-down door and the outside front panel of the drop-down door.

9. A safe, comprising:

an interior chamber, having a volume defined by a pair of side walls, a rear wall, a ceiling and a floor;

a drop-down door further defining the volume of the interior chamber; an illuminated shelf in the interior chamber, wherein the drop-down door has an inner side, an outside front panel and a document pocket therebetween, the inner side covered by a work surface, the work surface concealing the document pocket; and a shelf lock assembly for locking the safe to an external structure.

10. The safe as described in claim 9, wherein the floor has a floor panel covering the floor such that when the drop-down door is fully open, the work surface of the drop-down door and the floor panel are congruent, precluding a gap, and forming a continuous working area.

11. The safe as described in claim 10, wherein the shelf lock assembly is concealed below the floor panel.

12. The safe as described in claim 11, wherein the shelf lock assembly further comprises a mounting plate, a plurality of bolts each with a head and a plurality of openings in the floor.

13. The safe as described in claim 12, wherein the mounting plate has a square having four sides and four corners with a thumb tab on each side and a curvilinear slot on each corner, the four slots engaging the heads of the bolts when the bolts are placed through the openings in the floor of the safe and into the external structure.

14. A safe, comprising:

a shell, having a rear wall, a pair of side walls, a ceiling, a floor, the pair of side walls, the ceiling, and the floor each having an edge, the edges in combination defining an open front;

a liner within the shell, the liner covering the rear wall, and substantially covering the pair of side walls and the ceiling, defining an interior chamber;

a drop-down door for closing the open front, further defining the interior chamber; and a floor panel covering the floor of the interior chamber further defining the interior chamber, the floor panel concealing a shelf lock assembly configured for locking the safe to an external structure.

15. The safe as described in claim 14, wherein the drop-down door has an inner side, an outside front panel and a document pocket therebetween, the inner side covered by a work surface, the work surface concealing the document pocket.

16. The safe as described in claim 15, wherein the floor panel and the work surface of the drop-down door when the drop-down door is fully open are congruent, precluding a gap, and in combination, form a planar working area.

17. The safe as described in claim 16, wherein the shelf lock assembly further comprises a mounting plate, a plurality of bolts each with a head and a plurality of openings in the floor.

18. The safe as described in claim 17, wherein the mounting plate has a square having four sides and four corners with a thumb tab on each side and a curvilinear slot on each corner, the four slots engaging the heads of the bolts when the bolts are placed through the openings in the floor of the safe and into the external structure, locking the heads of the bolts into the curvilinear slots when the mounting plate rotates.

19. The safe as described in claim 18, further comprising a locking mechanism assembly within the drop-down door having two pairs of pins, a first pair of pins on a right side of the drop-down door and a second pair of pins on a left side of the drop-down door, a first pin orthogonal to a second pin within each pair, the two pairs connecting by a rod driven by a rotational motor that drives the pins outwardly to lock and inwardly to unlock the drop-down door.

* * * * *